United States Patent [19]

Yamaguchi

[11] Patent Number: 4,738,106

[45] Date of Patent: Apr. 19, 1988

[54] STARTING APPARATUS FOR STIRLING ENGINES

[75] Inventor: Kazuaki Yamaguchi, Kariya, Japan

[73] Assignee: Aisin Seiki Kabushiki Kaisha, Aichi, Japan

[21] Appl. No.: 10,968

[22] Filed: Feb. 4, 1987

[30] Foreign Application Priority Data

Mar. 31, 1986 [JP] Japan ..... 61-74472

[51] Int. Cl.[4] ..... F02G 1/06

[52] U.S. Cl. ..... 60/521; 60/517

[58] Field of Search ..... 60/517, 521, 525, 646, 60/656; 62/6

[56] References Cited

U.S. PATENT DOCUMENTS

| | | | |
|---|---|---|---|
| 3,371,491 | 3/1968 | Pinter . | |
| 3,372,539 | 3/1968 | Reinhoudt . | |
| 3,458,994 | 8/1969 | Heffner . | |
| 3,466,867 | 9/1969 | Brandes . | |
| 3,550,371 | 12/1970 | Jaspers . | |
| 3,554,672 | 1/1971 | Brandes . | |
| 3,600,886 | 8/1971 | Jaspers et al. . | |
| 3,999,388 | 12/1976 | Nystrom | 60/521 |
| 4,045,978 | 9/1977 | Abrahams et al. | 60/521 |
| 4,677,824 | 7/1987 | Hasegawa et al. | 60/521 |

FOREIGN PATENT DOCUMENTS

| | | | |
|---|---|---|---|
| 2274790 | 1/1976 | France . | |
| 46-23534 | 7/1971 | Japan . | |
| 46-23536 | 7/1971 | Japan . | |
| 25077 | 2/1984 | Japan | 60/517 |
| 131735 | 5/1973 | United Kingdom . | |

OTHER PUBLICATIONS

Patent Abstracts of Japan, vol. 8, No. 120 (M-300) [1557], Jun. 6, 1984; JP-A-59-25077 (Aishin Seki K.K.) 08-02-1984.

Patent Abstracts of Japan, vol. 7, No. 173 (M-232) [1318], Jul. 30, 1983; JP-A-58-77146 (Aishin Seiki K.K.) 10-05-83.

"Automotive Technology Development Contractors' Coordination Meeting", Oct. 26-29, 1981, Dearborn, Michigan, 19th Summary Report, sponsored by U.S. Dept. of Energy, pp. 188-195.

*Primary Examiner*—Stephen F. Husar

*Attorney, Agent, or Firm*—Burns, Doane, Swecker & Mathis

[57] ABSTRACT

A Stirling engine in which a working space is communicated with a working gas tank through a minimum cycle pressure line having an accelerating valve and a one-way valve and a maximum cycle pressure line having a decelerating valve and a one-way valve is provided with a starting apparatus including a bypass valve provided between the two pressure lines. When the engine is to be started, the bypass valve is opened and a starting motor is set into operation. The bypass valve is closed immediately after the Stirling engine starts, thus enabling the engine to quickly begin operating in a self-supporting manner.

1 Claim, 2 Drawing Sheets

STARTING APPARATUS FOR STIRLING ENGINES

BACKGROUND OF THE INVENTION

1. Field of the Invention

This invention relates to a Stirling engine and, more particularly, to a starting apparatus for a Stirling engine adapted to drive a freon compressor.

2. Description of the Prior Art

An example of an apparatus for starting a Stirling engine is disclosed in the specification of Japanese patent application Laid-Open (KOKAI) No. 59-25077. The Stirling engine includes a minimum cycle pressure line having an accelerating valve and a one-way valve, a maximum cycle pressure line having a decelerating valve and a one-way valve, and a working gas tank with which a working space is communicated through the minimum and maximum cycle pressure lines. The starting apparatus includes a bypass valve provided between the minimum and maximum cycle pressure lines, and a starting motor which is set into operation after the bypass valve is opened, thereby starting the engine.

A problem encountered in this conventional arrangement is that since the bypass valve is left open after the engine is started, an output is not produced and self-supporting operation is not achieved until the engine is sufficiently heated. This means that the starting motor must operate for an extended period of time.

SUMMARY OF THE INVENTION

An object of the present invention is to provide a Stirling engine starting apparatus which enables the operating time of the starting motor to be shortened.

According to the present invention, the foregoing object is attained by providing a starting apparatus for a Stirling engine of the type in which a working space is communicated with a working gas tank through a minimum cycle pressure line having an accelerating valve and a first one-way valve and a maximum cycle pressure line having a decelerating valve and a second one-way valve, the apparatus comprising a bypass valve provided between the minimum cycle pressure line and maximum cycle pressure line downstream of the first and second one-way valves, a starting motor operated following opening of the bypass valve to start the Stirling engine, and means for opening the bypass valve and operating the starting motor when the Stirling engine is to be started and for closing the bypass valve after the Stirling engine has been started.

Since the bypass valve is closed immediately after the Stirling engine is started, the engine attains a state in which it is capable of producing an output and thus quickly begins operating in a self-supporting manner. This makes it possible to shorten the operating time of the starting motor.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
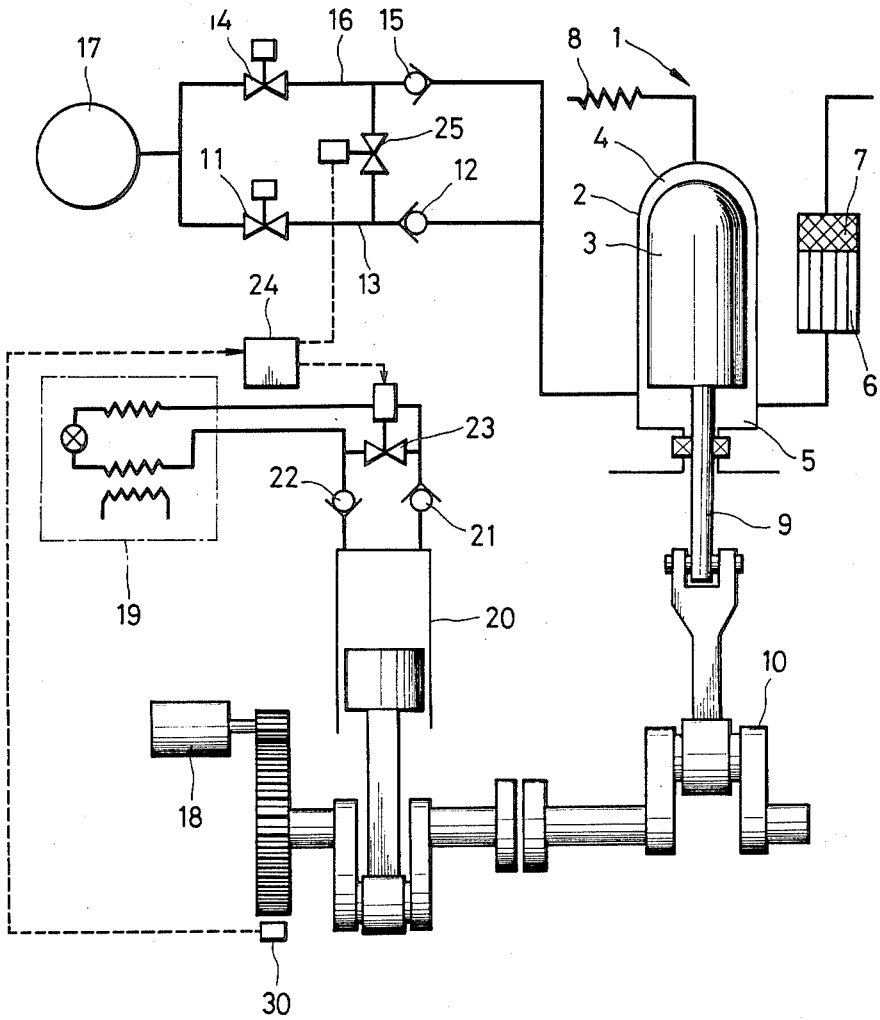
FIG. 1 is a schematic view of a Stirling engine which includes a starting apparatus in accordance with the present invention.

With reference first to FIG. 1, there is shown a Stirling engine 1 which includes a cylinder 2, a working piston 3 dividing the interior of the cylinder 2 into an expansion chamber 4 and a compression chamber 5, a cooler 6, regenerator 7 and heater 8 which communicate the compression chamber 5 with an expansion chamber of the neighboring cylinder (not shown), a rod 9 connected to the working piston 3, and a take-out mechanism 10 to which the rod 9 is connected. The Stirling engine 1 further includes a minimum cycle pressure line 13 having an accelerating valve 11 and a one-way valve 12, a maximum cycle pressure line 16 having a decelerating valve 14 and a one-way valve 15, and a working gas tank 17. The supply of a working gas to the working space of the engine is carried out by bringing the working gas tank 17 into communication with the compression chamber 5 through the pressure lines 13 and 16. The Stirling engine 1 is also provided with a starting motor 18 connected to the take-out mechanism 10 via a clutch, and a heat pipe 19 having a freon compressor 20, the latter serving as the source for driving the engine. The take-out mechanism 10 is coupled to the freon compressor 20. The engine 1 is started by operating the starting motor 18.

The freon compressor 20 is provided with a gas intake valve 21 and a discharge valve 22 in the lines connected to the heat pipe 19, and an unloader valve 23 is connected between these lines downstream of the valves 21, 22. A bypass valve 25 is arranged between the minimum pressure line 13 and maximum pressure line 16 downstream of the one-way valves 12, 15. The starting motor 18, unloader valve 23 and bypass valve 25 are controlled by a controller 24. A sensor 30 senses the rotational speed of the engine 1 and provides the controller 24 with a signal indicative thereof.

Figure 2:
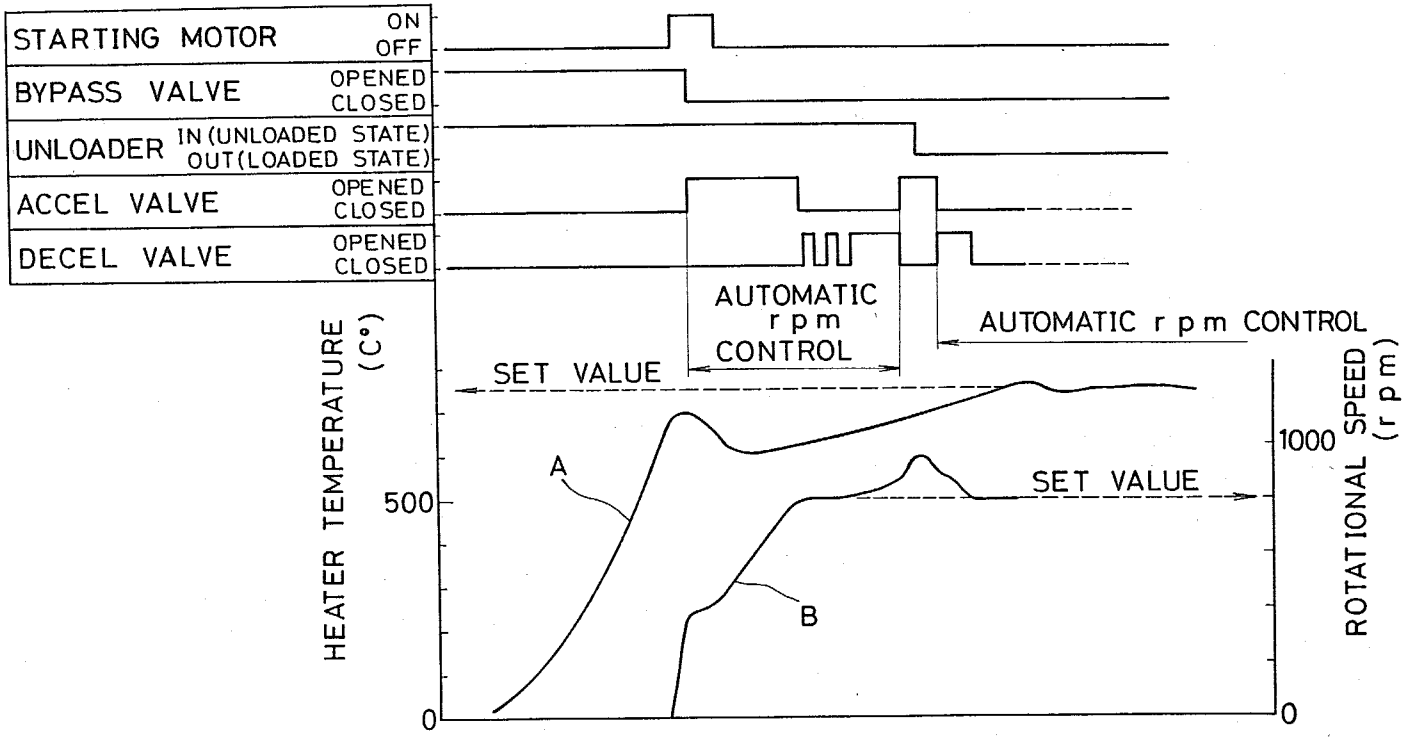
FIG. 2 is a combination of a waveform diagram and graph useful in describing the operation of the starting apparatus shown in FIG. 1.

When the Stirling engine 1 is to be started, the bypass valve 25 is opened to reduce the gas compressing work that is performed in the working space. This reduces the engine starting torque and, hence, diminishes the load on the starting motor 18. Let us describe the starting procedure in more detail with reference to FIGS. 1 and 2.

(1) With the bypass valve 25 in the open state, the controller 24 sets the starting motor 18 into operation when the temperature of a heater (not shown) heating the working gas exceeds a set value. Curve A in FIG. 2 indicates the heater temperature.

(2) Immediately after the motor 18 starts operating, the controller 24 closes the bypass valve 25. The accelerating valve 11 provided in the minimum pressure line 13 and the decelerating valve 14 provided in the maximum pressure line 16 are operated in an automatic control state in such a manner that that the engine rotational speed will attain a set value. Curve B in FIG. 2 indicates the rotational speed of the Stirling engine 1.

(3) When the Stirling engine 1 attains a rotational speed higher by a fixed rpm than the set value, the decelerating valve 14 is closed and the accelerating valve 11 is opened.

(4) The controller 24 releases the unloader valve 23 of the freon compressor 20.

(5) The accelerating valve 11 and the decelerating valve 14 are operated in a state for automatically controlling the rotational speed of the engine.

In accordance with the above method, neither the load of the engine 1 nor the load of the freon compressor 20 is impressed upon the starting motor 18 when the motor is started. The starting motor 18 therefore need not be large in size and can be operated for a period of time shorter than that required in the prior art. Moreover, since the load ascribable to the freon compressor 20 is impressed upon the take-out mechanism 10 after the engine output is raised, the engine will not stop due to an inadequate output.

As many apparently widely different embodiments of the present invention can be made without departing from the spirit and scope thereof, it is to be understood that the invention is not limited to the specific embodiments thereof except as defined in the appended claims.

What is claimed is:

1. A starting apparatus for a Stirling engine of the type in which a working space is communicated with a working gas tank through a minimum cycle pressure line having an accelerating valve and a first one-way valve and a maximum cycle pressure line having a decelerating valve and a second one-way valve, the pressure lines being connected through a bypass valve and the engine having a take-out mechanism for operating a compressor of a loading part including input and output ports connected together through an unloader valve and having a starter motor, said appartus comprising:

controller means for receiving a signal indicative or the rotational speed of the engine, closing said by-pass valve immediately after said starting motor starts, and opening said accelerating valve immediately prior to the loaded state of said loading part which is provided by closing said unloader valve.

* * * * *